US005918701A

United States Patent [19]

Rogelja

[11] Patent Number: 5,918,701

[45] Date of Patent: Jul. 6, 1999

[54] ROPING DEVICE

[76] Inventor: Boris Rogelja, 9 Nelson Avenue, Padstow, NSW, Australia

[21] Appl. No.: 08/855,053

[22] Filed: May 13, 1997

[51] Int. Cl.[6] ..... B66D 3/08

[52] U.S. Cl. ..... 182/234; 182/239

[58] Field of Search ..... 182/239, 234, 182/236, 231; 188/65.2, 65.5

[56] References Cited

U.S. PATENT DOCUMENTS 4,934,665 6/1990 Nelson ..... 182/239

*Primary Examiner*—Alvin Chin-Shue
*Attorney, Agent, or Firm*—Klein & Szekeres, LLP

[57] ABSTRACT

A roping device having an automatic emergency brake includes a generally elongate body having an attachment means at one end, a first rotatable sheave mounted on the body having an annular groove defining a generally semi-circular guide path for a rope, and a braking mechanism mounted to the body generally adjacent the first sheave for selectively braking the rope which, in use, passes there-through. The braking mechanism is biased towards an engaged position in which the rope is prevented from moving in a first direction through the device.

An emergency release mechanism holds the braking mechanism away from its engaged position during normal operation of the device so that the rope is allowed to move through the device in the first direction. The release mechanism includes a centrifugal trigger means associated with the sheave, a plate member rotatably mounted on the body adjacent the sheave, about the same axis as the sheave and being positionable in an engaged position holding the braking mechanism away from its engaged position, and a disengaged position in which the braking mechanism is released into its engaged position.

The centrifugal trigger means includes a lobe which projects laterally from the plate member at a predetermined radius from the rotational axis, and a member which is mounted on the sheave and is movable against a bias force from a retraced position wherein it does not obstruct movement of the plate member and the lobe about the rotational axis, to an extended position by centrifugal force when in use the speed of rotation of the sheave exceeds a predetermined triggering speed. In the extended position the member engages the lobe to cause the plate member to rotate with the sheave into its disengaged position, which triggers the release of the braking mechanism.

20 Claims, 4 Drawing Sheets

ROPING DEVICE

FIELD OF THE INVENTION

The present invention relates to a roping device which is suitable for use by person who wishes to descend a shear face of a building, cliff or the like with safety.

BACKGROUND OF THE INVENTION

If a person needs to descend from a height by for example, climbing down a ladder or cliff face or the like, for safety reasons it is often necessary for the person to be attached in some way to the ladder or any convenient securing point so that, in the event the person slips and falls, he/she will be prevented from falling to the ground. Clearly, any device for this purpose should preferably be, in use, unobtrusive to allow the user to make the descent without significant interference.

It is an object of the present invention to provide such a roping device.

SUMMARY OF THE INVENTION

The present invention provides a roping device comprising:

a generally elongate body defining an attachment means at one end;

a first rotatable sheave mounted on the body and having an annular groove defining a generally semi-circular guide path for a rope;

a braking mechanism mounted to the body generally adjacent the first sheave for selectively braking the rope which, in use, passes therethrough, the braking mechanism being biased towards an engaged position wherein the rope is prevented from moving in a first direction through the device; and an emergency release mechanism to hold the braking mechanism away from its engaged position during normal operation of the device whereby the rope is allowed to move through the device in the first direction, the release mechanism acting to release the brake mechanism into its engaged position when, in use, the rope moves through the device in the first direction in excess of a predetermined rate.

The release mechanism preferably includes a centrifugal trigger means associated with the sheave which triggers the release of the braking mechanism when, in use, the speed of rotation of the sheave exceeds a predetermined triggering speed.

Preferably, the release mechanism also includes a plate member rotatably mounted on the body adjacent the sheave, the plate member being rotatable about the same axis as the sheave and being positionable in an engaged position holding the braking mechanism away from its engaged position, and a disengaged position wherein the braking mechanism is released into its engaged position; and wherein the centrifugal trigger means includes at least one part which projects laterally from the plate member at a predetermined radius from the rotational axis, and another part which is mounted on the sheave and is movable against a bias force from a retracted position wherein it does not obstruct movement of the plate member and the at least one part about the rotational axis, to an extended position by a centrifugal force wherein at least a portion thereof is at the predetermined radius and engages the at least one part to cause the plate member to rotate with the sheave into its disengaged position.

Preferably, the plate member is generally circular with a first radius, and has a lobe part extending along a portion of its periphery which projects radially outwards with a second radius larger than the first radius.

Preferably, the lobe part extends about 120° around the periphery of the plate member and the second radius is generally constant along its length.

The braking mechanism preferably includes a bearing surface against which the release mechanism bears so as to hold the braking mechanism away from its engaged position, the release mechanism further including a follower part having a portion which is adjacent the periphery of the plate member and another portion which is adjacent the bearing surface of the braking mechanism, the follower part being moveable such that, when the plate member is in its engaged position the lobe part bears against the one portion and the other portion bears against the bearing surface so as to hold the braking mechanism away from its engaged position.

Preferably, the follower part is pivotally mounted to the body intermediate the sheave and the braking mechanism.

The at least one part of the trigger means is preferably in the form of a plurality of pins being arranged at the predetermined radius at generally equal angular spaced positions around the rotational axis, and projecting generally in the axial direction into an annular recess of the sheave; and wherein the other part is a finger member pivotally mounted within the recess about a pivot axis and which is biased by a spring member into its retracted position wherein the sheave is permitted to rotate relative to the plate member in the first direction of the rope through the device, and is movable by the centrifugal force into an extended position wherein a portion of the finger member obstructs the pins to prevent rotational movement of the sheave relative to the plate member such that the plate member will rotate with the sheave.

Preferably, the trigger means also includes an end stop for the finger member in its engaged position. The end stop may conveniently be an internal axially extending surface of the annular recess in the sheave.

In use, the user sets the device with the release mechanism in its engaged position so as to maintain the braking mechanism out of engagement with the rope. With the rope secured at one end to the user and extending around the sheave and through the braking mechanism, and with the free end of the rope being allowed to feed through the device, the user can descend the ladder or cliff face at a steady rate without the trigger means triggering release of the braking mechanism. In the event that the user slips and falls, the tail end of the rope will be caused to feed through the device at a much faster rate which will cause the sheave to rotate quickly and the trigger means to trigger and release the braking mechanism to thereby prevent the tail end of the rope from passing through the device and halt the descent of the user.

Preferably, the device also has a ratchet mechanism which acts between the sheave and the plate member to allow the sheave to rotate relative to the plate in the first direction of movement of the rope through the device, and to obstruct such relative rotational movement in an opposite direction of movement of the rope through the device.

In this way, when the locking mechanism is in its engaged position (eg after the trigger means has been triggered to release the braking mechanism in an emergency, and the user has again ready to descend further, the user can pull the end of the rope through the device in the opposite direction (ie which will hoist the user upwards) causing the sheave to rotate. This activates the ratchet mechanism so that the plate member rotates with the sheave back into the engaged position of the plate member. In practice, the user need only pull the rope a short distance in the opposition direction before the plate member is back into its engaged position. Once the plate member is in its engaged position with the braking mechanism caused to be disengaged from the rope, the user can then continue to descend by steadily feeding the tail end of the rope in the first direction through the device.

Preferably, the braking mechanism includes a rope guide defining a first braking surface and a braking member pivotally mounted about an axis spaced from the first braking surface, the braking member having a second braking surface and being biased into an engaged position wherein, in use, the rope is received between, and is in contact with the first and second braking surfaces; and wherein the braking member is arranged so that, in use, the rope is prevented from moving in the first direction.

BRIEF DESCRIPTION OF THE DRAWINGS

A preferred form of the present invention will now be described, by way of example only, and with reference to the accompanying drawings, wherein.

DETAILED DESCRIPTION OF A PREFERRED EMBODIMENT

Figure 1:
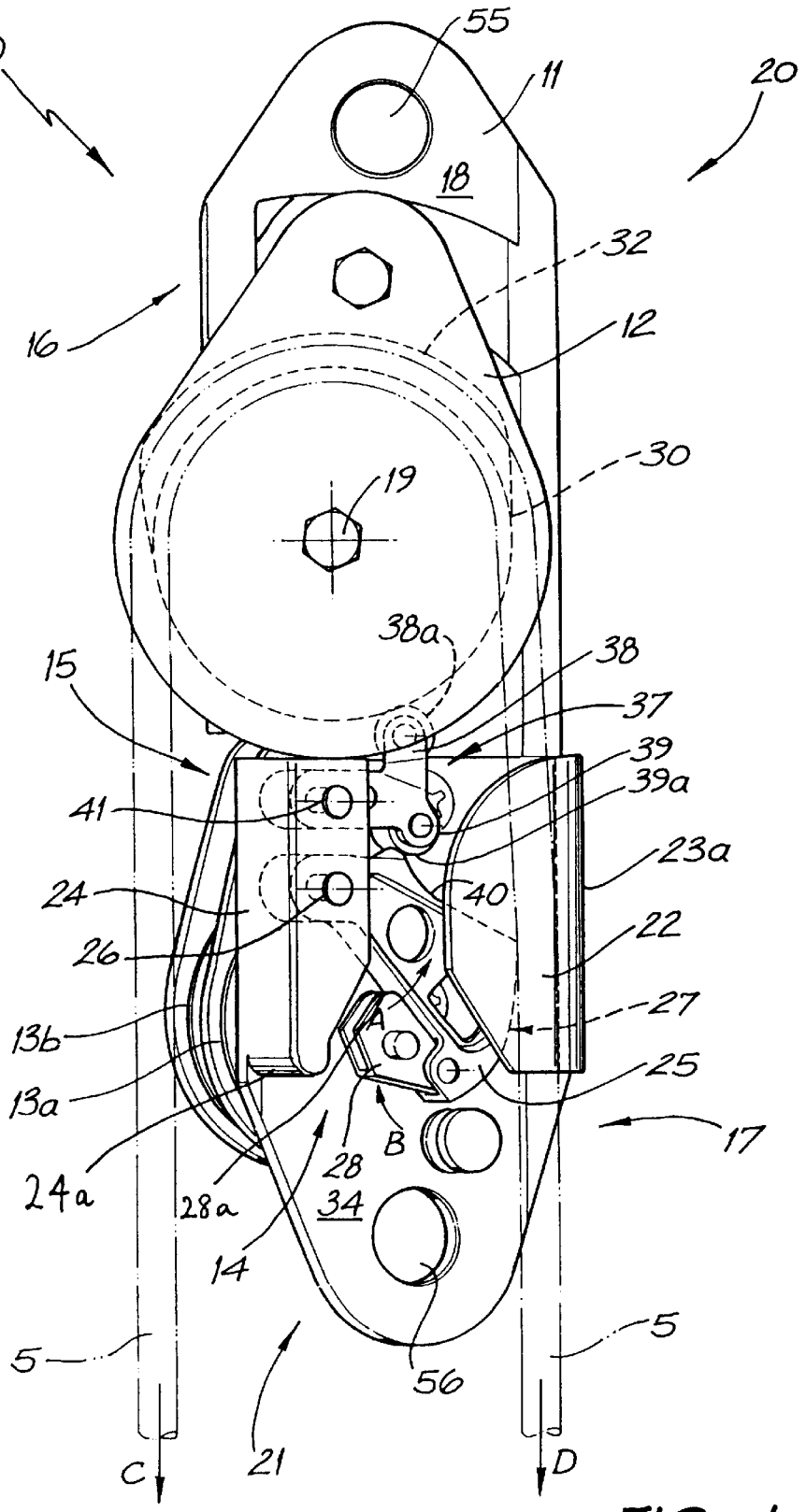
FIG. 1 is a plan view showing one side of the device of the present invention.

Referring to the drawings, FIG. 1 shows a roping device, generally indicated at 10, comprising a body 11, a first rotatable sheave 12, second and third rotatable sheaves 13*a*, 13*b*, and a rope braking mechanism 14 associated with an emergency release mechanism 15.

The body 11 is generally elongate with two distinct parts 16, 17. The upper body part 16 includes a flat plate 18 and the lower body part 17 includes another flat plate 34. The plates 18, 34 extend away from a common longitudinal side edge 23*a* so as to define an angle of about 20° between the planes of the plates 18, 34.

Figure 2:
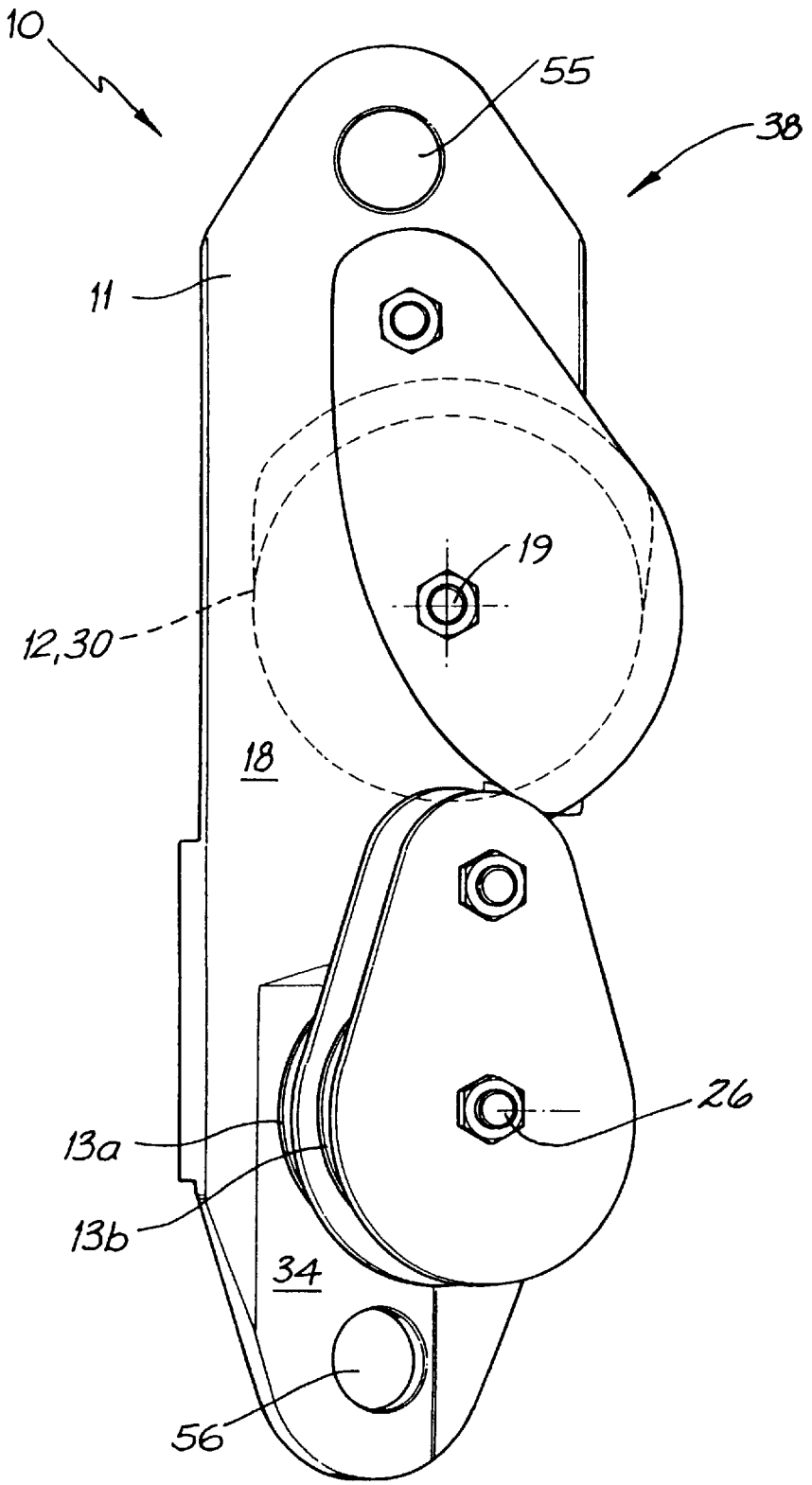
FIG. 2 is an inverted plan view showing the other side of the device of FIG. 1.

The first sheave 12 is rotatably mounted on front side 20 of the body on the plate 18 about an axle 19 projecting generally normal to the plate 18. The first sheave 12 has an annular groove which, in use, defines a generally semi-circular guide path for a rope 5. One end of the guide path is generally aligned with the braking mechanism 14 which is mounted on front side 20 of the body. The other end of the guide path is on/opens onto the reverse side 38 of the body 11, the reverse side being illustrated in FIG. 2.

The braking mechanism 14 is mounted on one side 21 of the plate 34 and includes a generally U-shaped channel 22 extending a predetermined distance along the common side edge 23*a* of the plate 34. There is also a formation 24 which is used to pivotally mount a braking member 25 about an axle 26 projecting normally from the plate 34.

The braking member 25 has a curved braking surface 27 which is adapted to frictionally engage a rope 5. The surface defines an array of small spikes (not illustrated in the drawings). The braking member 25 is biased in the direction A into an engaged positioned in which the rope 5 is wedged between the braking surface 27 and an opposing part of the U-shaped channel 22 preventing the rope 5 being pulled in the direction C when tension is applied to the rope to pull the rope in direction C. When a tension force is applied in the opposite direction D, the braking member 25 allows the rope 5 to generally freely pass through the U-shaped channel 22.

The braking mechanism 14 also includes a latch 28 pivotally mounted on the braking member 25 and biased in the direction B. The latch 28 can be moved against the biasing force into an open position whilst the braking member 25 is also pivoted against its biasing force into a fully retracted position. The latch 28 is then released and is caused to engage the formation 24, in particular, upper end 28*a* of the latch contacts lower end 24*a* of that formation so as to hold the braking member 25 in its retracted position.

The second and third sheaves 13*a*, 13*b* are both rotatably mounted on the reverse side 38 of the body 11 on the plate 34 about an axle 21 (refer to FIGS. 2 and 4) which projects normally to the plate 34.

The body 11 also includes first and second attachment points 55, 56 at each longitudinal end thereof. The attachment points are in the form of holes 55, 56 in the respective plates 18, 34.

The hole 55 is intended to allow the user to connect the device 10 by way of a karabiner 1, to a rung of a ladder (not shown) or any other convenient fixing point.

Figure 4:
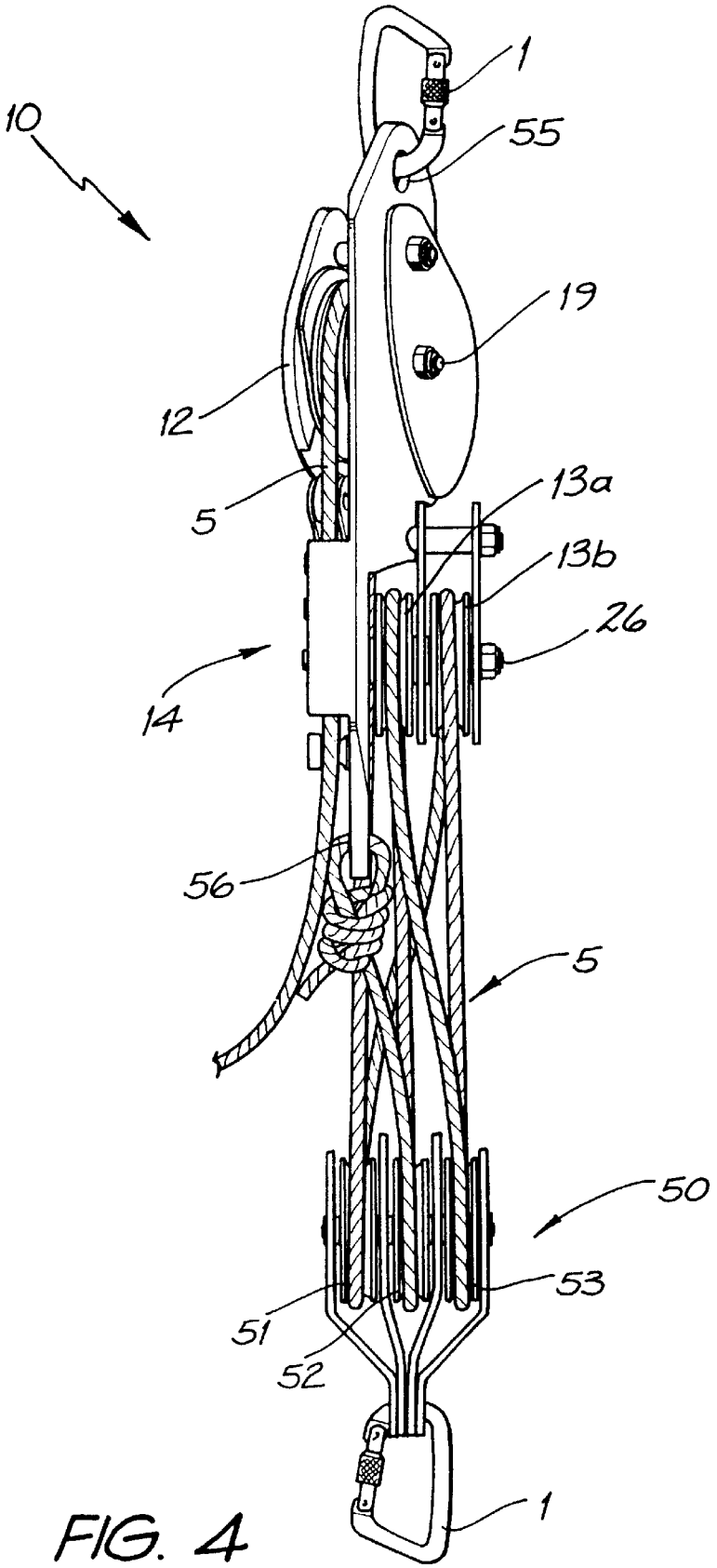
FIG. 4 is a schematic illustration of the path of a rope through the device and a sheave block.

The other hole 56 can be used to connect one end of the rope 5 to the device 10 when it is being used as part of a block and tackle arrangement as is described below, and as illustrated in FIG. 4 of the Drawings.

Figure 3A:
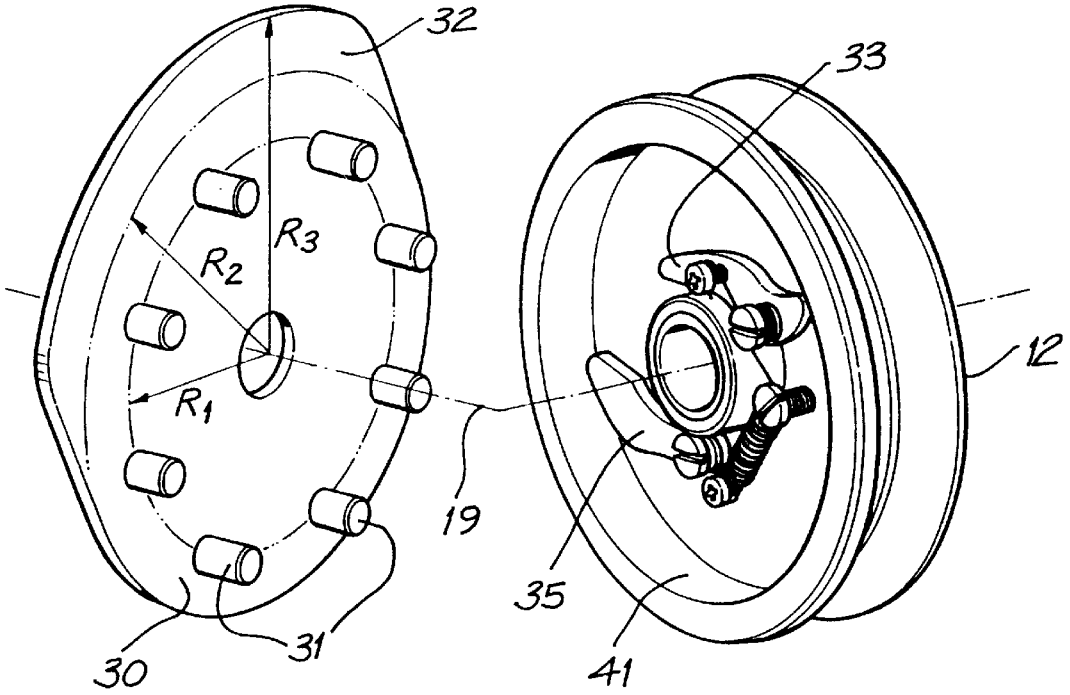
FIG. 3 is a schematic exploded perspective view of the release mechanism of the device of the present invention.
Figure 3B:
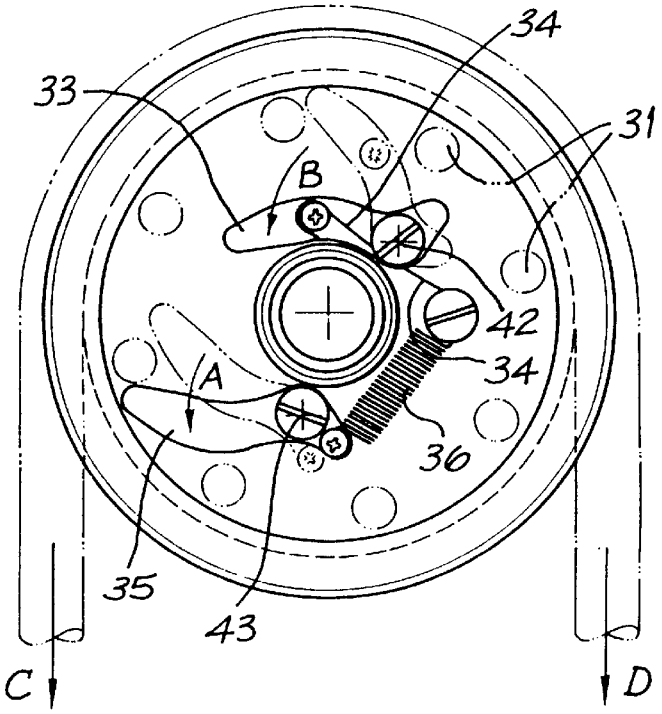

The emergency release mechanism 15, best seen in FIG. 1 and in FIGS. 3A and 3B, includes a plate member 30 rotatably mounted on the body immediately adjacent the sheave 12. The plate member 30 is rotatable about the same rotational axis 19 as the sheave. The release mechanism 15 also has a centrifugal triggering mechanism associated with the sheave 12 and plate member 30 which operates in case of emergency to cause the plate member 30 to rotate with the sheave 12 as described below.

The peripheral edge of the plate member 30 acts as a cam surface and has a first portion having a generally constant radius $R_2$ from the rotational axis 19, and another portion defining a lobe part having a generally constant radius $R_3$ which is larger than radius $R_2$. There are also ramp surfaces which provide smooth transition between the lobe part and the remainder of the periphery of the plate 30.

The plate member 30 is oriented generally parallel to the plate 18 of the upper body 16, and spaced from the plate 18 by the sheave 12. Advantageously, since the plate 18 lies in a plane which is angled with respect to the plane of the plate 34 of the lower body part 17, the plate member 30 and the sheave 12 are, at least on one side, below the plane of the plate 34. Also the portion of the plate member 30 nearest a cam follower part 37 (described below) is generally aligned with the plate of movement of that cam follower part 37 which is mounted on the lower body part 17. Thus the angle between the plates 18 and 34 of the upper and lower body parts 16, 17 compensates for the spacing of the plate member 30 from the plate 18.

The cam follower part 37, best seen in FIG. 1, has a first arm 38 with a roller 38*a* which contacts the periphery of the plate member 30, and a second arm 39 angularly spaced from the first arm 38 and having another roller 39*a* which contacts a bearing surface 40 of the braking member 25. Each roller rotates about its own axis, with the axis of roller 39*a* being normal to plate 34, and the axis of roller 38*a* being normal to plate 18, thus the angle defined between those axes corresponds to the angle defined between the plates 18 and 34. The cam follower part 37 is pivotally mounted on the formation 24 formed on the lower body part 17 of the body 11 about a pivot axis 41. The cam follower part 37 and its rollers 38*a* and 39*a* are arranged such that, when the roller 38*a* contacts the lobe part 32 of the periphery of the plate 30, the other roller 39*a* bears against the bearing surface 40 of the braking member 25 to cause the brake member 25 to pivot about its pivot axis 26 against the bias force and into a disengaged position wherein the braking surface is spaced from the rope 5 and wherein the rope 5 is able to move through the device in the first direction C.

A triggering mechanism for engaging the plate 30 with the sheave 12, best seen in FIGS. 3*a* and 3*b*, includes a plurality of pins 31 fixed to the plate member 30 at radius $R_1$ from the pivot and equal angular spacings around the rotational axis 19 and which, when the device 10 is assembled, extend into an annular recess 41 in the sheave 12. A first finger member 33 is pivotally mounted within the recess 41 about a pivot axis 42 so as to be movable between a retracted position spaced radially inwardly from the pins 31, to an extended position wherein an end portion of the finger bears against an end stop formed by a radially outer surface of the recess 41. In that extended position an intermediate portion of the finger member 33 obstructs a path of movement of the pins 31 so as to prevent relative rotational movement of the plate member 30 and sheave 12 in the first direction of movement C of the rope 5 through the device 10.

The finger member 33 is biased by a spring member 34 into its retracted position, and will move into its extended position under centrifugal force when the rotational speed of the sheave 12 exceeds a predetermined rotational triggering speed.

The device 10 is used in conjunction with a sheave block 50 having first, second and third sheaves 51, 52 and 53 respectively, and which is attached by way of a karabiner to the user for the object being lowered. One end of the rope 5 is attached to the attachment point 56 of the device 10. The rope 5 extends down to the sheave block 50 and around a third sheave 53, back up to the device 10 and around the third sheave 13*b*, back down to the sheave block 50 and around the second sheave 52, back up to the device 10 and around the second sheave 13*a*, back down to the sheave block 50 and around the first sheave 51, and back up to the device 10 and around the sheave 12 and finally through the braking mechanism 14. The tail end of the ropes should be free to feed into the device 10 as the user descends. This block and tackle type arrangement gives a 7:1 mechanical advantage. It will also be appreciated that the angle of the sheave 12 relative to the lower body part 17 allows the rope 5 to be transferred from the reverse side 38 of the body 11 back to the front side 20 after it has moved around the sheaves 13*a*, 13*b* (ie. which are mounted on the reverse side 38). This allows the rope 5 to be generally aligned and minimises the amount of rubbing contact between the adjacent portions of the rope.

In an alternative arrangement, the user can tie one end of the rope 5 to himself, with the rope 5 extending through the braking mechanism 14 and around the first sheave 12 with the tail of the rope extending back down to the user. This arrangement dispenses with the sheave block 50 and the second and third sheaves 13*a*, 13*b* are not used, and gives a 1:1 mechanical advantage. Accordingly, the device 10 can be used to as provide a varying mechanical advantage depending on how many of the sheaves (13*a*, 13*b* and 51, 52, 53) are used.

During normal operation, the love part 32 of the plate member 30 is caused to bear against the roller 38 of the cam follower member 37 so that the other roller 39 bears against the bearing surface 40 of the braking member 25 and retains the braking member 25 in a disengaged position. In this way, the rope is allowed to move in the direction C through the device 10.

In case of an emergency where, for eg, the user is falling out of control, the rope 5 will pass through the device 10 at a much faster rate causing the sheave 12 to rotate at a speed which exceeds the triggering speed such that the finger member 33 is caused to move to its extended position. The plate member 30 is thereby caused to rotate with the sheave 12 and the lobe part 32 of the plate member 30 is caused to move out of engagement with the roller 38 of the cam follower 37. The braking member 25 is then permitted to move into its engaged position preventing the rope 5 from moving in the direction C through the device 10 and further descent of the user/object is prevented.

The device 10 also incorporates a resetting mechanism in the form of another finger member 35 pivotally mounted within the recess 41 of the sheave 12 about a pivot axis 43. The finger member 35 is biased by a spring member 36 into an extended position bearing against the radially outer surface of the recess 41 and is arranged such that, in normal operation, when the sheave 12 rotates relative to the plate member 30 in the first direction C of the rope 5 through the device 10, and the finger member 35 rides up and over each of the pins 31 so as to not obstruct such relative rotational movement. If the rope 5 is moved in the opposite direction D, the finger member 35 will obstruct the path of movement of the pins 31 such that the plate member 30 will be caused to rotate with the sheave 12. In this way, the user can selectively pull the rope in the direction D so as to cause the plate member 30 to rotate until the lobe part 32 is again bearing against the roller 38 so that the braking member 25 is moved into and held in the disengaged position. Once the device 10 is back in this normal operating position, the rope 5 is again allowed to move through the device 10 in the direction C and normal descent can be resumed.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A roping device for operating on a rope, the device comprising:

a generally elongate body comprising a first plate having front face and a reverse face and a second plate having a front face and a reverse face, said plates having a common longitudinal side edge, said plates extending away from said side edge and defining an angle between the plates;

attachment mean defined at one end of the body;

a first rotatable sheave mounted on the front face of the first plate and having an annular groove defining a generally semi-circular guide path for the rope, the guide path having a first end and a second end, and wherein said first end of said guide path opens onto the front face of the first plate and the second end of the guide path opens onto or adjacent to the reverse face of the second plate;

a braking mechanism mounted on the front face of said second plate generally adjacent said first sheave and generally adjacent said first end of the guide path, the braking mechanism being arranged for selectively braking the rope which, in use, passes along the guide means and then through the braking mechanism, said braking mechanism being biased towards an engaged position wherein the rope is prevented from moving in a first direction through the device;

at least one second sheave disposed on the reverse face of the second plate and rotatable about an axle projecting normally to the second plate; and an emergency release mechanism adapted to hold said braking mechanism away from its engaged position during normal operation of the device, whereby the rope is allowed to move through said device in the first direction, the release mechanism acting to release said brake mechanism into its engaged position when, in use, the rope moves through said device in the first direction in excess of a predetermined rate.

2. The roping device of claim 1, wherein said release mechanism includes a plate member rotatably mounted on said body adjacent the sheave, said plate member being rotatable about the same axis as the sheave and being positionable in an engaged position holding said braking mechanism away from its engaged position, and a disengaged position wherein said braking mechanism is released into its en-aged position; and centrifugal trigger means, associated with said first sheave, for triggering the release of the braking mechanism when, in use, the speed of rotation exceeds a predetermine triggering speed, said trigger means including a first part that projects laterally from the plate member at a predetermined radius from the rotational axis, and a second part that is mounted on the sheave and is movable against a bias force from a retracted position wherein it does not obstruct movement of the plate member and the first part about the rotational axis, to an extended position by a centrifugal force, wherein at least a portion thereof is at the predetermined radius and engages the first part to cause the plate member to rotate with the sheave into its disengaged position.

3. The roping device of claim 2, wherein said plate member is generally circular, defining a first radius, and has a lobe part extending along a portion of its periphery which projects radially outward with a second radius larger than the first radius.

4. The roping device of claim 3, wherein said braking mechanism includes a bearing surface against which the release mechanism bears so as to hold the braking mechanism away from its engaged position, the release mechanism further including a follower part having a first portion that is adjacent the periphery of the plate member a second portion that is adjacent the bearing surface of the braking mechanism, the follower part being moveable such that, when the plate member is in its engaged position, the lobe part bears against the first portion and the second portion bears against the bearing surface so as to hold the braking mechanism away from its engaged position.

5. The roping device of claim 4, wherein said follower part is pivotally mounted to said body intermediate the sheave and the braking mechanism.

6. The roping device of claim 5, wherein said first part of the trigger means is preferably in the form of a plurality of pins being arranged at the predetermined radius at generally equal angularly spaced positions around the rotational axis, and which project generally in the axial direction into an annular recess of the sheave; and wherein the second part is a finger member pivotally mounted within the recess about a pivot axis and which is biased by a spring member into its retracted position wherein the sheave is permitted to rotate relative to the plate member in the first direction of the rope through the device, and is movable by centrifugal force into an extended position wherein a portion of the finger member obstructs the pins to prevent rotational movement of the sheave relative to the plate member such that the plate member will rotate with the sheave.

7. The roping device of claim 6, wherein said trigger means also includes an end stop for the finger member in its engaged position.

8. The roping device of claim 7, wherein said end stop comprises an internal axially extending surface of the annular recess in the sheave.

9. The roping device of claim 2, wherein the device further includes a resetting mechanism that acts between the sheave and the plate member to allow the sheave to rotate relative to the plate member in the first direction of movement of the rope through the device, and to obstruct such relative rotational movement in an opposite direction of movement of the rope through the device.

10. The roping device of claim 1, wherein said braking mechanism further includes a rope guide defining a first braking surface and a braking member pivotally mounted about an axis spaced from the first braking surface, the braking member having a second braking surface and being biased into an engaged position wherein, in use, the rope is received between, and is in contact with, the first and second braking surfaces; and wherein the braking member is arranged so that, in use, the rope is prevented from moving in the first direction.

11. A roping device for operating on a rope, the device comprising:

a generally elongate body comprising a first plate having a front face and a reverse face, and a second plate having a front face and a reverse face, said plates having a common longitudinal side edge, said plates extending away from said side edge and defining an angle of about 20 degrees between the plates;

attachment means defined at one end of the body;

a first rotatable sheave mounted on the front face of the first plate and having an annular groove defining a generally semi-circular guide path for the rope, the guide path having a first end and a second end, and wherein said first end of said guide path opens onto the front face of the first plate and the second end of the guide path opens onto or is adjacent to the reverse face of the second plate means;

a braking mechanism mounted on the front face of said second plate generally adjacent said first sheave and generally adjacent said first end of the guide path, the braking mechanism being arranged for selectively braking the rope which, in use, passes along the guide means and then through the braking mechanism, the braking mechanism being biased toward an engaged position in which position the rope is prevented from moving in a first direction through the device;

a second sheave disposed on the reverse face of the second plate and rotatable about an axle projecting normally to the second plate; and a release mechanism adapted to hold said braking mechanism away from its engaged position during normal operation of the device, whereby the rope is allowed to move through the device in the first direction, and wherein the release mechanism includes centrifugal trigger means associated with the sheave which triggers the release of the braking mechanism into an engaged position when, in use, the speed of rotation of the sheave exceeds a predetermined triggering speed.

12. The roping device of claim 11, wherein said release mechanism also includes a plate member rotatably mounted on the body adjacent said first sheave, the plate member being rotatable about the same axis as said first sheave and being positionable in an engaged position holding the braking mechanism away from its engaged position, and a disengaged position wherein the braking mechanism is released into its engaged position;

wherein said centrifugal trigger means includes a lobe part that projects laterally from the plate member at a predetermined radius from the rotational axis, and a member that is mounted on the sheave and is movable against a bias force from a retracted position wherein it does not obstruct movement of the plate member and the lobe part about the rotational axis, to an extended position by centrifugal force, wherein at least a portion of the member is at the predetermined radius and engages the lobe part to cause the plate member to rotate with the sheave into its disengaged position;

wherein said braking mechanism includes a bearing surface against which the release mechanism bears so as to hold the braking mechanism away from its engaged position, the release mechanism further including a follower part having a first portion that is adjacent the periphery of the plate member and a second portion that is adjacent the bearing surface of the braking mechanism, the follower part being moveable such that, when the plate member is in its engaged position, the lobe part bears against the first portion and the second portion bears against the bearing surface so as to hold the braking mechanism away from its engaged position; and wherein said device further includes a resetting mechanism which acts between the sheave and the plate member and which is arranged to allow the sheave to rotate relative to the plate member in the first direction of movement of the rope through the device, but to obstruct such relative rotational movement in an opposite direction of movement of the rope through the device so as to allow the lobe part of the plate member to be rotated by movement of the rope to engage the follower part of the release mechanism, thereby to disengage the braking mechanism.

13. A roping device comprising:

a generally elongate body comprising a first plate having a front face and a reverse face and a second plate having a front face and a reverse face, said plates having a common longitudinal side edge, said plates extending away from said side edge and defining an angle between the plates;

attachment means defined at one end of the body;

a first rotatable sheave mounted on the front face of the first plate and having an annular groove defining a generally semi-circular guide path for a rope, the guide path having a first end and a second end, and wherein said first end of said guide path opens onto the front face of the first plate and the second end of the guide path opens onto or is adjacent to the reverse face of the second plate means;

a braking mechanism mounted on the front face of said second plate means generally adjacent the first sheave and generally adjacent said first end of the guide path, the braking mechanism being arranged for selectively braking the rope which, in use, passes along the guide means and then through the braking mechanism, the braking mechanism being biased toward an engaged position wherein the rope is prevented from moving in a first direction through the device;

a second sheave disposed on the reverse face of the second plate and rotatable about an axle projecting normally to the second plate; and a release mechanism adapted to hold the braking mechanism away from its engaged position during normal operation of the device, whereby the rope is allowed to move through the device in the first direction, wherein the release mechanism includes:

a plate member rotatably mounted on the body adjacent the first sheave, said plate member being generally circular and defining a first radius and having a lobe part extending along a portion of its periphery which projects radially outward with a second radius larger than the first radius, the plate member being rotatable about the same axis as the first sheave and being positionable in an engaged position with the lobe part holding the braking mechanism away from its engaged position, and a disengaged position wherein the braking mechanism is released into its engaged position; and centrifugal trigger means which includes a part which projects laterally from the plate member at a predetermined radius from the rotational axis, and a member which is mounted on the sheave and is movable against a bias force from a retracted position wherein it does not obstruct movement of the plate member and the laterally-projecting part about the rotational axis, to an extended position by centrifugal force when, in use, the speed of rotation of the sheave exceeds a predetermined triggering speed, in which extended position the member engages the laterally-projecting part to cause the plate member to rotate with the sheave into its disengaged position wherein the lobe part is disengaged from the braking mechanism which triggers the release of the braking mechanism.

14. The roping device of claim 13, wherein said braking mechanism includes a bearing surface against which the release mechanism bears so as to hold said braking mechanism away from its engaged position, the release mechanism further including a follower part having a first portion which is adjacent the periphery of the plate member and a second portion which is adjacent the bearing surface of the braking mechanism, the following part being moveable such that, when the plate member is in its engaged position, the laterally-projecting part bears against the first portion, and the second portion bears against the bearing surface so as to hold the braking mechanism away from its engaged position.

15. The roping device of claim 14, wherein said follower part is pivotally mounted to the body intermediate the sheave and the braking mechanism.

16. The roping device of claim 13, wherein the angle defined between said first plate and said second plate is about 20 degrees.

17. The roping device of claim 13, wherein the braking mechanism includes a channel through which the rope passes, in use, the channel extending a predetermined distance along the common longitudinal side edge and a braking member defining a curved braking surface, the braking member being pivotally mounted to the front face of the second plate about a pivot axis extending normally to the second plate, the axis being located closer to the first sheave than to the braking surface, the braking mechanism being biased into an engaged position with the rope passing through the channel, the braking mechanism being arranged to allow the rope to pass generally freely in a direction away from the first sheave but which prevents the rope from being pulled in a direction toward the first sheave.

18. The roping device of claim 17, wherein the braking mechanism includes a latch pivotally mounted on the braking member and biased toward the braking member, and wherein the front face of the second plate defines a formation spaced from the channel, and wherein the latch can be moved against its biasing force into an open position, and the braking member may also be pivoted against its biasing force into a fully retracted position, the latch being engageable with the formation so as to hold the braking member in the retracted position.

19. The roping device of claim 13, wherein a third sheave is rotatably mounted on the axle on the reverse face of the second plate, and wherein the device includes an associated sheave block including three axially aligned sheaves.

20. The roping device of claim 18, further comprising a cam follower that is mounted on the front face of the second plate on a pivot, the cam follower having a first arm having a roller that contacts the periphery of the plate member and a second arm angularly spaced from the first arm and defining a second roller that contacts a bearing surface on the braking member, and wherein each roller rotates about its own axis with the axis of the first roller being substantially normal to the first plate and the axis of the second member being substantially normal to the second plate.

* * * * *